US009101232B1

(12) United States Patent
Newman

(10) Patent No.: US 9,101,232 B1
(45) Date of Patent: Aug. 11, 2015

(54) INDICATING APPARATUS AND SYSTEM FOR CAROUSEL BAGGING RACK

(71) Applicant: Kurt H. Newman, Conway, SC (US)

(72) Inventor: Kurt H. Newman, Conway, SC (US)

( * ) Notice: Subject to any disclaimer, the term of this patent is extended or adjusted under 35 U.S.C. 154(b) by 0 days.

(21) Appl. No.: 14/326,572

(22) Filed: Jul. 9, 2014

(51) Int. Cl.
*A47F 13/08* (2006.01)
*A47F 9/04* (2006.01)

(52) U.S. Cl.
CPC ..... *A47F 13/085* (2013.01); *A47F 9/04* (2013.01); *A47F 9/042* (2013.01); *A47F 2009/041* (2013.01)

(58) Field of Classification Search
CPC ..... A47F 5/05; A47F 7/28; A47F 9/042
USPC ..... 186/66, 67; 211/78, 85.4, 85.15; 248/95, 542, 550
See application file for complete search history.

(56) References Cited

U.S. PATENT DOCUMENTS

| | | | | |
|---|---|---|---|---|
| 5,115,888 | A | 5/1992 | Schneider | |
| 5,551,531 | A * | 9/1996 | Dumont | 186/61 |
| 5,992,570 | A | 11/1999 | Walter et al. | |
| 6,491,218 | B2 | 12/2002 | Nguyen | |
| 6,793,043 | B2 | 9/2004 | Nguyen | |
| 7,866,546 | B1 | 1/2011 | Vance | |
| 7,967,153 | B2 | 6/2011 | Simhaee | |
| 8,400,324 | B1 * | 3/2013 | Jaeger | 340/689 |
| 2004/0083026 | A1 * | 4/2004 | Barton et al. | 700/237 |

* cited by examiner

*Primary Examiner* — Mark Beauchaine
(74) *Attorney, Agent, or Firm* — P. Jeff Martin; The Law Firm of P. Jeffrey Martin, LLC

(57) ABSTRACT

An indicating apparatus and system for multi-bay carousel bagging-rack assemblies utilized in retail and grocery stores, wherein the indicating apparatus comprises illumination means, audible means, tactile means, and/or combinations thereof, and having assigned indication means for each separate bagging-bay provided by the bagging-rack assembly. The indicating apparatus may be manually or automatically activated and deactivated according to the position or location of purchased items placed into bags housed in the bagging-bays, communicating to the patron and/or cashier that purchased items are ready for transfer from the point-of-sale assembly to the patron's cart.

12 Claims, 4 Drawing Sheets

INDICATING APPARATUS AND SYSTEM FOR CAROUSEL BAGGING RACK

FIELD OF THE INVENTION

This invention relates to retail bagging of purchased items, and more particularly to a retail bagging system for carousel-type bagging structures.

BACKGROUND OF THE INVENTION

Multi-unit carousel bagging racks are predominantly used in large grocery and retail stores as a means for more quickly bagging purchased items and facilitating the transfer of the purchased items from the bagging rack to the purchaser. In particular, for a high-quantity order, such multi-unit carousel bagging racks allow the cashier and patron to operate in coordination to move the purchased items from the cashier to the patron and minimize the pauses experienced when non-carousel racks are utilized, by comparison. These pauses increase the point-of-sale transaction and cause additional wait-times for the patrons in each queue.

There are several concerns in utilizing multi-unit carousel racks for point-of-sale bagging of purchased items. For example, a multi-unit carousel rack may be configured to have at least three units or bays and may include nine units or bays. As the size of the carousel rack increases, the ability of the cashier and/or the patron to detect which bags have been filled and which bags are not filled becomes more difficult, especially when considering the opaque composition of the plastic bags used for bagging. Moreover, during peak shopping times, the desire of both cashier and patron to quickly complete the transaction can sometimes result in inattentiveness that yields purchased items that are left behind on the carousel rack, later discovered by the cashier or store personnel. Such incomplete transactions create additional costs for both the store and the patron. For example, the store must enter such information in a store log in the event the patron returns to claim their purchased items, consuming the time and effort of store personnel to record and maintain such information. Similarly, provided the patron discovers the oversight, the patron will need to return to the point-of-sale and attempt to recover the purchased items, resulting in time and travel costs.

Orphaned purchases are a frequent problem in most grocery and retail stores. Browsing Internet message board forums dedicated to retail purchasing experiences confirms that cashiers and patrons frequently overlook the final bag(s) of a transaction, which leads to customer dissatisfaction and frustration, and threatens to erode the goodwill of the retail establishment.

A search of the prior art did not disclose any patents that read directly on the claims of the instant invention; however, the following references were considered related:

U.S. Pat. No. 6,793,043 B2, issued in the name of Nguyen;

U.S. Pat. No. 6,491,218 B2, issued in the name of Nguyen;

U.S. Pat. No. 7,967,153, issued in the name of Simhaee;

U.S. Pat. No. 7,866,546 B1, issued in the name of Vance;

U.S. Pat. No. 5,992,570, issued in the name of Walter et al.; and

U.S. Pat. No. 5,115,888, issued in the name of Schneider.

Accordingly, there is an unresolved need to provide a mechanism or system for minimizing and/or eliminating instances of orphaned grocery and/or retail purchases, and thereby reducing dead-loss operational costs to grocers and/or retailers and purchase-costs to patrons.

SUMMARY OF THE INVENTION

Example embodiments provide an indicating apparatus and system for a carousel bagging-rack. The apparatus comprises indication means for identifying one or more bays containing purchased items. The apparatus comprises a base supporting the indication means and a spacer, and a platform supported by the spacer and defining a space or interval between the base and platform and protecting the indication means. Indication means may include illumination means, audible means, tactile means, and/or combinations of these means for communicating or alerting the patron and cashier of the filled bags and position within the bagging-bays.

The indicating system for a carousel bagging-rack comprises a carousel bagging-rack assembly having multiple bays or units for housing and retaining retail bags filled with purchased items. The bagging-rack assembly supports the indication apparatus in a position that is visible to patron and/or cashier, as necessary. The indication apparatus comprises a base supporting indication means and a spacer, and a platform supported by the spacer so that a space interval is defined between the base and the platform. Indication means may comprise illumination means, audible means, tactile means, and/or combinations of these means to communicate and alert the patron and/or cashier of purchased items and bags remaining in the carousel bagging-rack. The system may also include one or more automatic mechanisms or systems for activating and deactivating the indication means, including pressure sensitive switches in each bagging-bay, and/or interactive touch-screen displays for activating/deactivating indication means.

DESCRIPTION OF THE EMBODIMENT(S)

Figure 1:
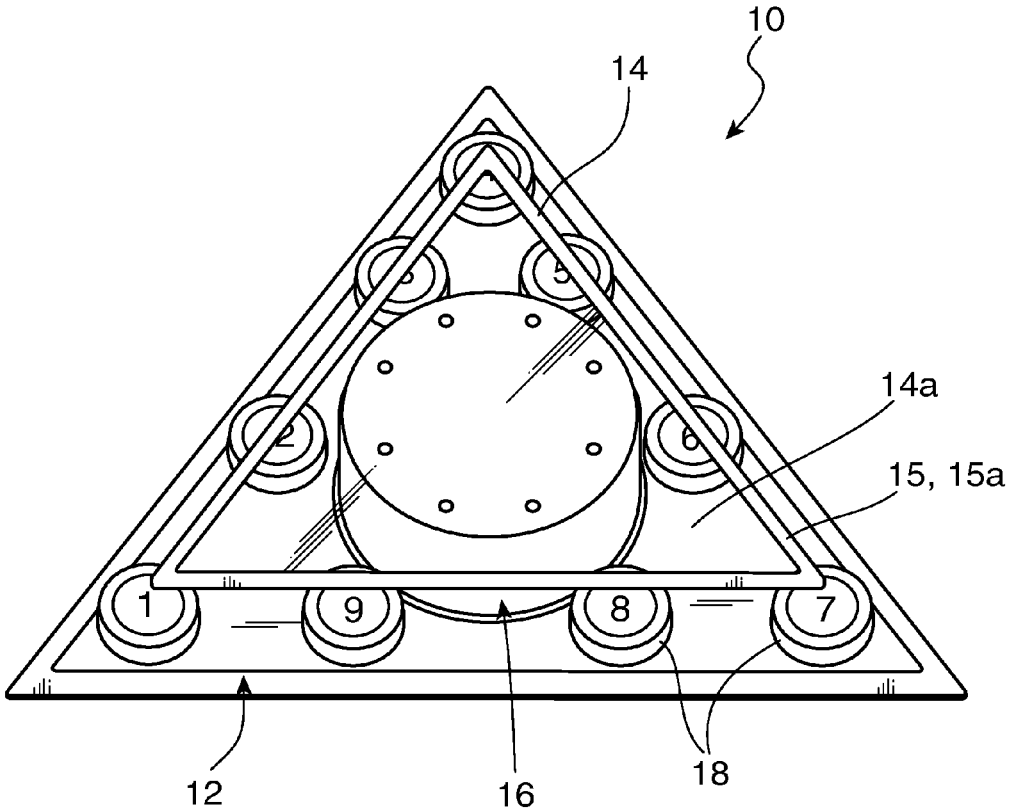
FIG. 1 illustrates an indicating apparatus, according to example embodiments.

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

An indicating apparatus 10 for a multi-unit carousel bagging-rack R is depicted in accordance with the illustrated figures appended hereto. In one embodiment, generally denoted in FIGS. 1 and 2, the apparatus 10 may include a base 12 and an elevated platform 14, the base 12 and platform 14 separated by a spacer 16. The base 12 supports the spacer 16 and the spacer 16 supports the platform 14. The base 12 also supports a plurality of indicating means 18.

The platform 14 may provide an auxiliary support 14*a* for supporting filled grocery or retail bags, and other items and articles thereatop. Thus, as an auxiliary support 14*a*, the platform 14 may comprise a variety of materials affording suitable rigidity, and strength characteristics and qualities for supporting filled grocery or retail bags, and other items and articles thereatop. Such materials include wood or faux wood, plastic, metals, combinations, or other suitable materials. In accordance to one embodiment, the platform 14 may be constructed of a lightweight, rigid material which may be selected from the group which includes, but is not limited to wood, plastic, thermoplastic, metal or a metallic-plastic composite. Preferred plastic and thermoplastic materials include, but are not limited to, polystyrene, polyvinyl chloride (PVC), polypropylene, polyolefin, acrylonitrile-butadiene-styrene (ABS), polyethylene, polyurethane, polycarbonate, or blends thereof, and ABS/Nylon blend. The platform 14 may further be constructed utilizing a common molding process such as injection molding, blow molding, extrusion, or other molding and fabricating methods.

Figure 2:
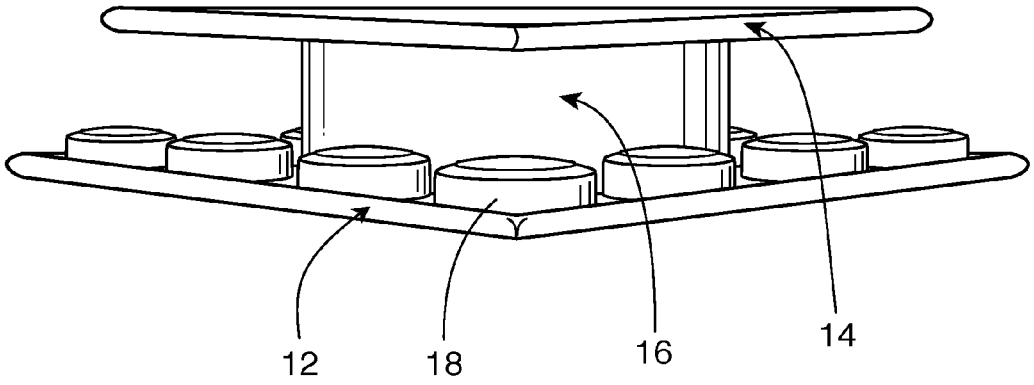
FIG. 2 is a side view of the apparatus of FIG. 1, according to example embodiments.

In accordance to one embodiment, the platform 14 may be constructed of a transparent or translucent material, as depicted in FIG. 1.

The base 12 may comprise a variety of materials including wood or faux wood, plastic, metals, combinations, or other suitable materials. Similar to the platform 14, the base 12 may be constructed of a material selected from the group which includes, but is not limited to wood, plastic, thermoplastic, metal or a metallic-plastic composite. Preferred plastic and thermoplastic materials include, but are not limited to, polystyrene, polyvinyl chloride (PVC), polypropylene, polyolefin, acrylonitrile-butadiene-styrene (ABS), polyethylene, polyurethane, polycarbonate, or blends thereof, and ABS/Nylon blend. The base 12 may further be constructed utilizing a common molding process such as injection molding, blow molding, extrusion, or other molding and fabricating methods. The base 12 may be constructed of a material which corresponds to or otherwise matches the material selected to construct platform 14. The base 12 may be configured in a variety of arrangements, and may be generally configured to match the arrangement of the multi-unit carousel bagging-rack R.

Figure 3A:
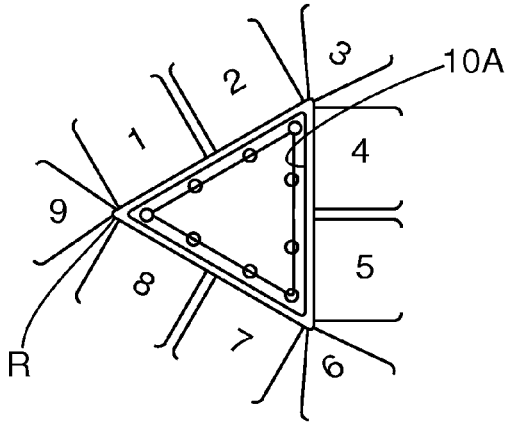
FIGS. 3A-3D illustrate multi-unit carousel bagging-racks in various configurations and an indicating apparatus for each rack having the same number of indicating means, according to example embodiments.
Figure 3B:
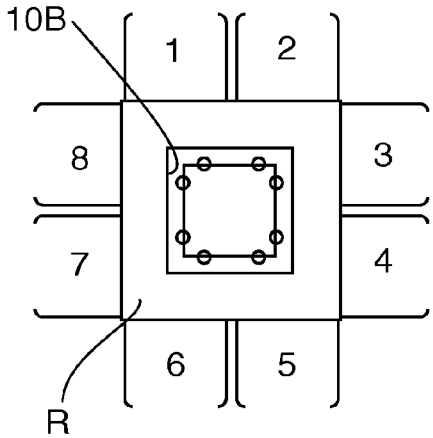
Figure 3C:
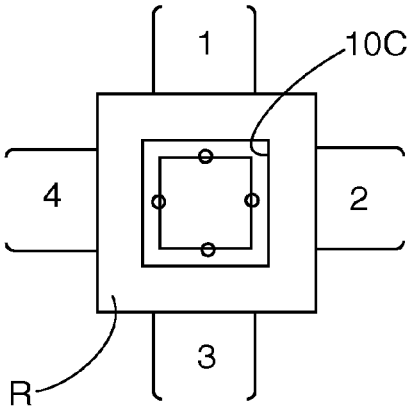
Figure 3D:
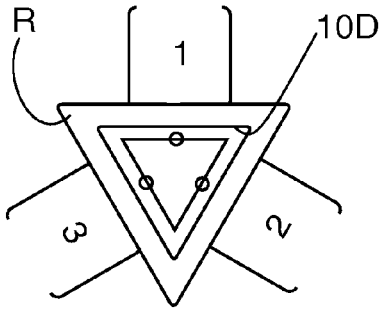

For example, as illustrated in FIGS. 3A through 3D, several examples of carousel bagging-racks are depicted, including: a 9-bay/unit (FIG. 3A); an 8-bay/unit (FIG. 3B); a 4-bay/unit (FIG. 3C); and a 3-bay/unit (FIG. 3D). Within each figure, each bay is sequentially labeled in a clockwise manner, so that, for example, the 9-bay unit will include labels 1-9 for each of the bays. For each multi-unit rack R, an apparatus 10A (FIG. 3A), 10B (FIG. 3B), 10C (FIG. 3C), and 10D (FIG. 3D) corresponding to the arrangement of the rack R illustrated so that the number of indicating means 18 corresponds to the number of bays/units of the rack R. However, the apparatus 10 is not limited to the specific arrangements depicted in FIGS. 3A through 3D, as other multi-unit carousel racks R are envisioned and the apparatus 10 is adaptable to such variations in the number of bays/units by addition or subtraction of the number of illumination means 18.

The spacer 16 may comprise a variety of materials and configurations. As depicted in the figures, the spacer 16 is a disc-shaped body disposed between the base 12 and the platform 14 to provide spacing between the base 12 and platform 14. However, the spacer 16 is not limited to a disc-shaped body, but instead may be formed in a variety of shapes and dimensions, provided that the spacer 16 provides the necessary spacing between the base 12 and platform 14. The spacing defined by the spacer 16 is necessary to prevent inadvertent activation or deactivation of one or more indicating means 18, especially by placement of items on the platform 14 which may be irregularly-shaped, or otherwise define a size which exceeds the perimeter of the platform 14 or extends beyond edges of any one or more sides comprising the perimeter of platform 14.

In particular reference to FIG. 1, the platform 14 further comprises a retainer 15 integrally formed as an upwardly and/or outwardly projecting, or bulbous lip 15*a* which protrudes moderately and extends continuously about the perimeter of platform 14. Alternatively, the retainer may be provided as a separate component and suitably mounted to the perimeter of platform 14. Filled grocery or retail bags may contain items and articles susceptible to sliding or rolling. Unbagged items and articles placed atop the platform 14 may also be susceptible to sliding or rolling. The retainer 15 functions to retain bagged and unbagged susceptibly mobile items and articles within the confines provided by the surface area of the upper surface of platform 14 enclosed by the retainer 15.

Indicating means 18 may comprise illumination means, audible means, tactile means, or a combination of one or more means to indicate the position of both filled and unfilled grocery or retail bags on the carousel bagging-rack R. It is envisioned that the indicating means 18 may be manually activated/deactivated, or automatically activated/deactivated through pressure sensitivity, or interactive touch-screen technology and associated hardware and/or software. Each indicating means 18 may be labeled and associated with a similarly labeled bay of the bagging-rack R for ease of use.

In one embodiment, indicating means 18 comprises manually activated/deactivated illumination means, such as depressible puck-shaped lights or other lights activated/deactivated. For example, as depicted, depressible puck-shaped lights may be used so that the cashier will depress to identify whether a bay/unit of the carousel rack R possesses a filled or unfilled bag. Illumination may be differentiated to designate filled and unfilled bags, such as by using different colors or different states (e.g., steady illumination versus pulsating or flashing illumination), or a combination thereof. It is also envisioned that illumination means may be powered by low-voltage means self-contained within the illumination means or by an adapter-fed external source, transmitted by means of a slip ring that allows the transmission of power from a stationary structure to a rotating structure.

In another embodiment, indicating means 18 comprises manually activated/deactivated audible means, such as a depressible device or other similar device. When activated by the cashier, the device will provide a low-volume alert to indicate which bag position is filled.

In another embodiment, indicating means 18 comprises manually activated/deactivated tactile means, such as a depressible device or other similar device. When activated, the device will provide a change in surface composition to distinguish between a filled and unfilled bag, and may include incorporation of various indicia to make such a distinction.

Figure 4:
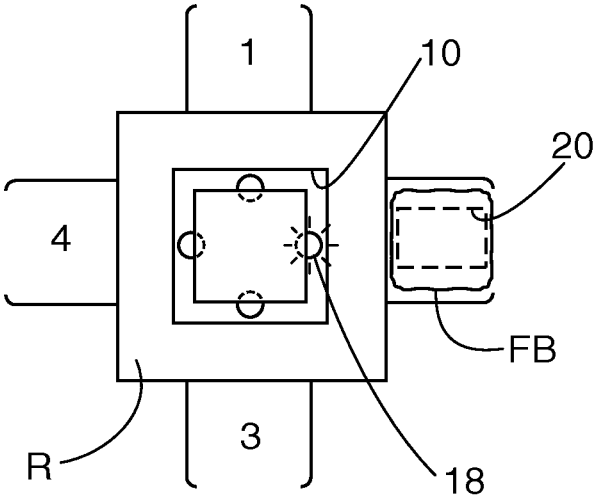
FIG. 4 illustrates an example of a carousel bagging-rack having a pressure-sensitive switch in each bay/unit of the bagging rack, according to example embodiments.

In another embodiment, such as that depicted in FIG. 4, indicating means 18 comprises an automatically activated/deactivated mechanism for activating/deactivating illumination, audible, and/or tactile means, including such combinations. In one embodiment, a pressure sensitive switch or device 20 (shown in broken lines hidden below a filled bag FB) may be positioned so that when a bag is filled with an item, the weight of the item activates the pressure sensitive switch or device 20 that then actuates the illumination, audible, and/or tactile means for indicating the position of the filled bag FB. Once the bag FB is removed from the bay/unit, and the weight and pressure are released and removed, the pressure sensitive switch returns to a non-activated state, and the illumination, audible, and/or tactile means is deactivated. Although the pressure sensitive switch embodiment may have a variety of applications, and is not limited to those specifically disclosed, it is envisioned to have a particularly useful application for self-checking kiosks, which operate on the basis of not having an attending cashier for each terminal. As such, the pressure sensitive switch embodiment relieves the need for a cashier and for the patron to step into the shoes of a cashier.

In another embodiment, indicating means 18 comprises an automatically activated/deactivated mechanism for activating/deactivating illumination, audible, and/or tactile means, including such combinations, utilizing a touch-screen and associated software. In this embodiment, the cashier will have an interactive touch-screen display that identifies the carousel bagging-rack R and the individual bays/units, and by selectively touching the appropriate icon associated with the individual bay/unit, the cashier may properly identify the bagging bay/unit that possesses a filled bag. Through the associated hardware and/or software, this selection is translated to activate the indicating means 18, including any illumination, audible, and/or tactile means used as the indicating means for the patron. By touching the previously selected icon, and thereby deactivating the associated indicating means 18, the patron is alerted to the displacement of the previously filled bag (presumably to the patron's shopping cart or other bag delivery cart).

It is envisioned that an embodiment combining some or all of the elements of the pressure sensitive automation and the touch-screen and associated hardware and/or software automation may be utilized consistent with the descriptions provided above. In such an embodiment, the pressure sensitive automation may operate as a redundancy to the cashier-directed automation controlled by the interactive touch-screen display and associated hardware and/or software.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. An indicating system for a carousel bagging-rack, the system comprising:

a carousel bagging-rack assembly comprising multi-bays;

an indicating apparatus comprising indication means for identifying one or more bays containing purchased items, wherein the indication means is assigned and labeled a bagging-rack bay having a similar label; and an automatic mechanism for communicating to the indicating apparatus that purchased items have been placed into one or more bays.

2. The system of claim 1, wherein the automatic mechanism comprises a pressure sensitive switch for each bagging-rack bay in communication with the indication means for activating and deactivating the indication means.

3. The system of claim 1, wherein the automatic mechanism comprises an interactive touch-screen display in communication with indication means for activating and deactivating the indication means.

4. The system of claim 1, wherein the bagging-rack assembly supports the indicating apparatus.

5. The system of claim 4, wherein the bagging-rack assembly further supports the automatic mechanism.

6. The system of claim 1, wherein the indicating apparatus comprises:

a base supporting a plurality of indication means and a spacer; and a platform depending from the spacer.

7. The system of claim 6, wherein the indication means comprises illumination means.

8. The system of claim 6, wherein the indication means comprises audible means.

9. The system of claim 6, wherein the indication means comprises tactile means.

10. A carousel bagging-rack assembly comprising:

a carousel bagging-rack having multi-bays, the bagging-rack supporting an indicating apparatus;

an indicating apparatus comprising a base supporting a plurality of indication means and a spacer, and a platform depending from the spacer, the indicating apparatus arranged to align each indication means with each bay of the bagging-rack, wherein the indication means is assigned and labeled a bagging-rack bay having a similar label; and a selection means for selectively activating and deactivating indication means.

11. The assembly of claim 10, wherein the indication means comprises one of illumination means, audible means, and tactile means.

12. The assembly of claim 10, wherein the selection means comprises a pressure sensitive switch for each bagging-rack bay in communication with the indication means assigned to each bagging-rack bay, the pressure sensitive switch actuates the indication means for indicating the position of a filled bag.

* * * * *